US010071410B2

(12) United States Patent
Nishimura et al.

(10) Patent No.: US 10,071,410 B2
(45) Date of Patent: Sep. 11, 2018

(54) MANUFACTURING APPARATUS AND MANUFACTURING METHOD FOR STRETCH-FORMED PRODUCT

(71) Applicant: NIPPON STEEL & SUMITOMO METAL CORPORATION, Tokyo (JP)

(72) Inventors: Ryuichi Nishimura, Tokyo (JP); Yorifumi Sakamoto, Tokyo (JP); Toru Yonebayashi, Tokyo (JP); Yoshihiko Masuo, Tokyo (JP); Yoshiaki Nakazawa, Tokyo (JP); Koji Hashimoto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/038,941

(22) PCT Filed: Dec. 10, 2014

(86) PCT No.: PCT/JP2014/082664
§ 371 (c)(1),
(2) Date: May 24, 2016

(87) PCT Pub. No.: WO2015/098519
PCT Pub. Date: Jul. 2, 2015

(65) Prior Publication Data

US 2017/0001232 A1 Jan. 5, 2017

(30) Foreign Application Priority Data

Dec. 26, 2013 (JP) ..... 2013-269853

(51) Int. Cl.
*B21D 25/04* (2006.01)
*B21D 24/04* (2006.01)
(Continued)

(52) U.S. Cl.
CPC ..... *B21D 24/04* (2013.01); *B21D 22/22* (2013.01); *B21D 25/04* (2013.01); *B21D 35/003* (2013.01)

(58) Field of Classification Search
CPC ..... B21D 24/04; B21D 22/20; B21D 22/22; B21D 25/04
See application file for complete search history.

(56) References Cited

U.S. PATENT DOCUMENTS 5,701,777 A 12/1997 Yamanaka et al.
6,196,043 B1 * 3/2001 Ehardt ..... B21D 22/22 72/350
(Continued)

FOREIGN PATENT DOCUMENTS

CN 101683672 A 3/2010
JP 2-37921 A 2/1990
(Continued)

OTHER PUBLICATIONS

Canadian Office Action dated Mar. 30, 2017, for Canadian Application No. 2,931,281.
(Continued)

*Primary Examiner* — Debra Sullivan
(74) *Attorney, Agent, or Firm* — Birch, Stewart, Kolasch & Birch, LLP

(57) ABSTRACT

There is provided a manufacturing apparatus and a manufacturing method for a stretch-formed product which can improve the yield of material in the stretch forming performed while clamping the blank by the lock beads. The manufacturing apparatus for a stretch-formed product includes a die and a blank holder which have clamping surfaces facing each other, a punch that, in a state where a margin of a blank of a sheet material is clamped by the clamping surfaces of the die and the blank holder, relatively presses a forming region of the blank into the die and
(Continued)

thereby performs stretch forming on the forming region of the blank, and lock beads that are provided on the clamping surfaces of the die and the blank holder in mutually similar shapes and have first surfaces, second surfaces that intersect with the first surfaces, and third surfaces that intersect with the second surfaces from outer edges toward the centers of the die and the blank holder, the first surfaces each having a plurality of depression-protrusion parts.

3 Claims, 17 Drawing Sheets

(51) Int. Cl.
*B21D 22/22* (2006.01)
*B21D 35/00* (2006.01)

(56) References Cited

U.S. PATENT DOCUMENTS

| | | | | |
|---|---|---|---|---|
| 7,322,222 | B2 * | 1/2008 | Kodaka | B21D 24/04 72/309 |
| 9,592,544 | B2 * | 3/2017 | Inoue | B21D 22/26 |
| 2012/0279272 | A1 | 11/2012 | Zhou et al. | |

FOREIGN PATENT DOCUMENTS

| | | | |
|---|---|---|---|
| JP | 6-542 | A | 1/1994 |
| JP | 8-267154 | A | 10/1996 |
| JP | 9-29348 | A | 2/1997 |
| JP | 9-225552 | A | 9/1997 |
| JP | 2003-164922 | A | 6/2003 |
| JP | 2004-9107 | A | 1/2004 |
| JP | 2007-245188 | A | 9/2007 |
| JP | 2010-115674 | A | 5/2010 |
| JP | 2011-147976 | A | 8/2011 |
| JP | 2012-210642 | A | 11/2012 |
| JP | 2013-180336 | A | 9/2013 |
| RU | 1584221 | C | 9/1994 |

OTHER PUBLICATIONS

International Search Report for PCT/JP2014/082664 dated Jan. 13, 2015.
Written Opinion of the International Searching Authority for PCT/JP2014/082664 (PCT/ISA/237) dated Jan. 13, 2015.
Chinese Office Action and Chinese Search Report, dated Jan. 24, 2017, for Chinese Application No. 201480068739.4, with a partial English translation of the Chinese Office Action.
Japanese Office Action, dated Oct. 11, 2016, for Japanese Application No. 2015-554727, along with a partial English translation.
Extended European Search Report, dated Jul. 6, 2017, for corresponding European Application No. 14873861.0.
Korean Office Action dated Jul. 17, 2017, for corresponding Korean Application No. 10-2016-7015882, with partial English translation.
Chinese Office Action, dated Aug. 9, 2017, for corresponding Chinese Application No. 201480068739.4, along with a partial English translation.
Russian Office Action and Search Report, dated Aug. 30, 2017, for corresponding Russian Application No. 2016123936/02, along with a partial English translation.
Korean Office Action dated Feb. 12, 2018 for corresponding Korean Application No. 10-2016-7015882, with partial English translation.

* cited by examiner

MANUFACTURING APPARATUS AND MANUFACTURING METHOD FOR STRETCH-FORMED PRODUCT

TECHNICAL FIELD

The present invention relates to a manufacturing apparatus and a manufacturing method for a stretch-formed product. Specifically, the present invention relates to a manufacturing apparatus and a manufacturing method for a stretch-formed product obtained by stretching a blank between a punch and a die in a state of clamping a margin of the blank by the die and a blank holder such that the blank does not flow into a forming region.

BACKGROUND ART

In general, press-forming of thin plates is roughly classified into the three of bending forming, stretch forming and drawing. The bending forming is a method of forming the blank by bending it by using the die and the punch without clamping the margin of the blank. In contrast thereto, the stretch forming and the drawing are methods of forming the blank by pressing the punch against a forming region located at the center of the blank in a state of clamping the margin of the blank by the die and the blank holder.

FIG. 13 is an explanatory diagram showing the stretch forming. As shown in FIG. 13, in the stretch forming, a punch 4 is relatively pressed into a die 2 in a state of clamping mainly a clamp target part 1*a* provided on a margin of a blank 1 by trapezoidal beads 2*a* and 3*a* as one form of lock beads which are provided on/in the die 2 and a blank holder 3. Accordingly, a stretch-formed product is formed by stretching the blank 1 such that the margin of the blank 1 does not substantially flow (move) toward a forming region 1*b* of the blank 1, which corresponds to a product part. It is general that, for example, in automobile components, large-sized components having comparatively simple shapes such as a door outer panel, a hood outer panel, and a roof panel are manufactured by the stretch forming.

In contrast thereto, in the drawing, the punch is relatively pressed into the die in a state of clamping mainly the clamp target part provided on the margin of the blank by draw beads which are provided on/in the die and the blank holder. In the drawing, the amount of the blank which flows from the margin of the blank toward the forming region of the blank which corresponds to the product part is properly controlled per component by the draw beads during forming. Thereby, formability is controlled such that cracks, wrinkles and so forth are not generated in/on the product. It is general that a component which has a comparatively complicated shape, such as, for example, a side panel outer in the automobile components is manufactured by the drawing.

Both of the lock beads used in the stretch forming and the draw beads used in the drawing are the ones for adjusting a tensile force to be loaded on the blank such that shape defects such as the cracks and wrinkles and excessive surface deflection are not generated in the forming region (the product part) of the blank like this. However, while the stretch forming is the one for causing the blank not to flow from the margin of the blank into the forming region, the drawing is the one for causing the blank to flow from the margin of the blank into the forming region. Accordingly, the lock beads used in the stretch forming are different from the draw beads used in the drawing for controlling the inflow of the blank in the point that flowing of the blank from the margin of the blank into the forming region is substantially eliminated.

Hitherto, as the beads which are provided in/on the die and the blank holder and clamp the blank margin in order to eliminate flowing of the blank into the forming region, such trapezoidal beads as shown in FIG. 13 are generally known. The trapezoidal beads are substantially trapezoidal in section and clamp the blank 1 such that the blank 1 does not flow into it by deformation resistance of bending and unbending deformation of a trapezoidal corner part and frictional resistance caused by contact of the beads 2*a* and 3*a* each provided in/on the die 2 and the blank holder 3 with the blank 1.

FIG. 14 is an explanatory diagram showing one example of the blank 1 which has the clamp target part 1*a* to be clamped by the beads and the forming region 1*b* corresponding to the product part (a rear outer panel) of the blank 1 and is used in the stretch forming. FIG. 14 is the example of the blank 1 in a case of manufacturing two rear door outer panels from one blank 1.

As exemplified in FIG. 14, an outer peripheral part 1*c* of the clamp target part 1*a* of the blank 1 is cut off along a trim line 1*d* and is cut down together with the clamp target part 1*a*. Accordingly, if the outer peripheral part 1*c* and the clamp target part 1*a* can be set as small as possible after having ensured a blank clamping force which is required for the stretch forming, the entire size of the blank 1 will become small as much. Thereby, the material yield in the stretch forming is improved. In particular, since the stretch forming is used for forming the comparatively large-sized components as described above, an effect of reducing amount of used amount of material, that is, of improving the material yield owing to miniaturization of the blank 1 is large.

FIG. 15 to FIG. 17 are explanatory diagrams showing states of the vicinity of the trapezoidal bead 2*a* in a case of performing the stretch forming by using a die having the general trapezoidal beads 2*a* and 3*a*. FIG. 15 is perspective views showing the states before and after clamping the blank 1 by the die 2 and the blank holder 3. FIG. 16 is a sectional view showing the vicinity of the trapezoidal beads 2*a* and 3*a* including the clamp target part 1*a*, the outer peripheral part 1*c* and the trim line 1*d* of the blank 1. FIG. 17 is a top view showing the vicinity of the trapezoidal beads 2*a* and 3*a* including the clamp target part 1*a*, the outer peripheral part 1*c* and the trim line 1*d* of the blank 1. Incidentally, in FIG. 15 to FIG. 17, although a boundary between the inside and outside of the product is shown by a broken line, a region of a length L1 is a bead corresponding part of the blank 1 to be clamped by the beads 2*a* and 3*a* and is a part to be generally discarded.

The trapezoidal beads 2*a* and 3*a* are adapted to obtain a blank clamping force which is sufficient for the stretch forming by causing the bending and unbending deformation resistance of four trapezoidal corner parts 2*a*-1, 2*a*-2, 3*a*-1, and 3*a*-2 to generate. In mass forming, it is necessary to make the length of a sectional straight side part 2*a*-3 long to some extent in order not to destroy the trapezoidal bead 2*a* and in order to cause the bending and unbending deformation resistance of the trapezoidal corner parts 2*a*-1 and 2*a*-2 to be generated independently in the respective corner parts. Accordingly, the pressing length L1 of the trapezoidal beads 2*a* and 3*a* in a direction orthogonal to the trim line 1*d* becomes inevitably long. Therefore, it is difficult to shorten the pressing length L1 and to miniaturize the blank 1 with the trapezoidal beads 2*a* and 3*a*.

In Patent Literature 1, there is disclosed a drawing method of, in a drawing apparatus which is provided with a die, a punch and a blank holder, drawing a material in a state of holding the material by the blank holder and a facing die in which draw beads having continuous bead parts that are non-parallel to a line parallel to a drawing profile of the material are formed on wrinkle pressing surfaces.

In Patent Literature 2, there is disclosed a drawing method of, in a drawing apparatus which is provided with a die, a punch and a blank holder, providing a movable die face which configures a die face part and is movable relative to a die body and a movable blank holder which faces the movable die face and is movable relative to a blank holder body, making the movable die face and the movable blank holder freely advance and retreat from the outside to the inside toward a forming depressed part in the die, driving the movable die face and the movable blank holder from the outside to the inside in association with pushing of the blank and thereby performing drawing in high yield such that a shock line does not enter a product part.

In Patent Literature 3, there is disclosed a press die device which performs drawing and stretching by forming a bead on one die and forming a bead containing part for containing the bead in a part facing the bead on another die, wherein step parts individual protruding heights of which are gradually reduced laterally are provided on a leading end of the bead, stepped depressed parts which correspond to the step parts are provided in the bead containing part, unevenness which corresponds to the step parts in a case where a blank material is nipped and held between the both is formed on an edge of the blank material and thereby generation of wrinkles can be prevented even in a case of being applied to a press machine having a low load capacity.

In Patent Literature 4, there is disclosed a bead to be provided on a wrinkle pressing surface of a draw die, the draw bead being configured by a vertical wall part and a corrugated part which is formed to be consecutive to the vertical wall part and is corrugated in section.

CITATION LIST

Patent Literature

Patent Literature 1: JP H9-29348A
Patent Literature 2: JP H9-225552A
Patent Literature 3: JP H8-267154A
Patent Literature 4: JP 2007-245188A

SUMMARY OF INVENTION

Technical Problem

The method described in Patent Literature 1 is the one which intends to lock the material such that the material does not flow from the outside of the bead into the inside of the bead by using the beads which are trapezoidal in section and are corrugated in top view. In that method described in Patent Literature 1, the blank is clamped with the deformation resistance of bending and unbending deformation of the trapezoidal corner part, a surface pressure of the bead relative to the blank and expansion/contraction deformation resistance according to the corrugated shape. The method described in Patent Literature 1 may increase bead passing resistance of the material by extending the material up to a region outside a part which is clamped by the bead. Accordingly, the method described in Patent Literature 1 cannot improve the material yield due to an increase in parts which are cut off along the drawing profile and discarded.

The method described in Patent Literature 2 is the one which targets on drawing which involves flowing of the material although aiming to improve the yield of material. Accordingly, the method described in Patent Literature 2 cannot improve the yield of material in the stretch forming which does not involve flowing of the material.

The method described in Patent Literature 3 cannot improve the yield of material in the stretch forming because the bead length in the direction which is orthogonal to the material flowing direction is inevitably increased.

Although the draw bead described in Patent Literature 4 is the bead which aims to improve the yield of steel material by suppressing flowing-in of the material, it purports a draw bead to be used in the drawing. Accordingly, the draw bead described in Patent Literature 4 is not the one which improves the yield of material by preventing flowing-in of the material in lock beads to be used in the stretch forming.

The present invention has been made in view of the above mentioned problems and an object of the present invention is to provide a manufacturing apparatus and a manufacturing method for a stretch-formed product which can improve the yield of material in the stretch forming performed while clamping the blank by the lock beads.

Solution to Problem

To solve the problem, according to an aspect of the present invention, there is provided a manufacturing apparatus for a stretch-formed product, the manufacturing apparatus including: a die and a blank holder which have clamping surfaces facing each other; a punch that, in a state where a margin of a blank of a sheet material is clamped by the clamping surfaces of the die and the blank holder, relatively presses a forming region of the blank into the die and thereby performs stretch forming on the forming region of the blank; and lock beads that are provided on the clamping surfaces of the die and the blank holder in mutually similar shapes and have first surfaces, second surfaces that intersect with the first surfaces, and third surfaces that intersect with the second surfaces from outer edges toward the centers of the die and the blank holder, the first surfaces each having a plurality of depression-protrusion parts.

When the plurality of depression-protrusion parts are viewed from the outer edge toward the center of the die or the blank holder, the plurality of depression-protrusion parts may have any shape of a trapezoidal shape, a rectangular shape and a triangular shape or a combined shape thereof.

The plurality of depression-protrusion parts may each have a fourth surface and a fifth surface intersecting with each other, the fourth surface and the fifth surface may intersect with the second surface, and at least one of the fourth surface and the fifth surface may intersect with the first surface.

The plurality of depression-protrusion parts may each have the fourth surface and a sixth surface facing each other and the fifth surface that intersects with the fourth surface and the sixth surface, the fourth surface, the fifth surface and the sixth surface may intersect with the second surface, and at least one of the fourth surface, the fifth surface and the sixth surface may intersect with the first surface.

In a case where the plurality of depression-protrusion parts each have the triangular shape, a pitch interval of the plurality of depression-protrusion parts when the triangular shape is defined as one pitch may be within a range of 5 to 50 mm, and a rising angle of a surface of the depression-protrusion part may be within a range of 10 to 40 degrees.

In a case where the plurality of depression-protrusion parts each have the trapezoidal shape or the rectangular shape, a pitch interval of the plurality of depression-protrusion parts when a set of a protruded shape and a depressed shape is defined as one pitch may be within a range of 5 to 50 mm and a height of the depression-protrusion part may be within a range of 1.0 to 10.0 mm.

In addition, in order to solve the above-mentioned problems, according to another aspect of the present invention, there is provided a manufacturing method for a stretch-formed product, the method including a step of clamping a margin of a blank of a sheet material by the clamping surfaces of the die and the blank holder which are provided with lock beads which have first surfaces, second surfaces which intersect with the first surfaces and third surfaces which intersect with the second surfaces from outer edges toward the centers of the die and the blank holder at positions corresponding to the margin of the blank of the sheet material, the first surfaces each having a plurality of depression-protrusion parts, and the lock beads being provided in mutually similar shapes, and a step of stretch-forming the blank by pressing a forming region of the blank toward the die by a punch in a state of clamping the margin of the blank by the die and the blank holder.

Advantageous Effects of Invention

According to the present invention, the yield of material in the stretch forming performed while clamping the blank by the lock beads can be improved.

DESCRIPTION OF EMBODIMENTS

Figure 1:
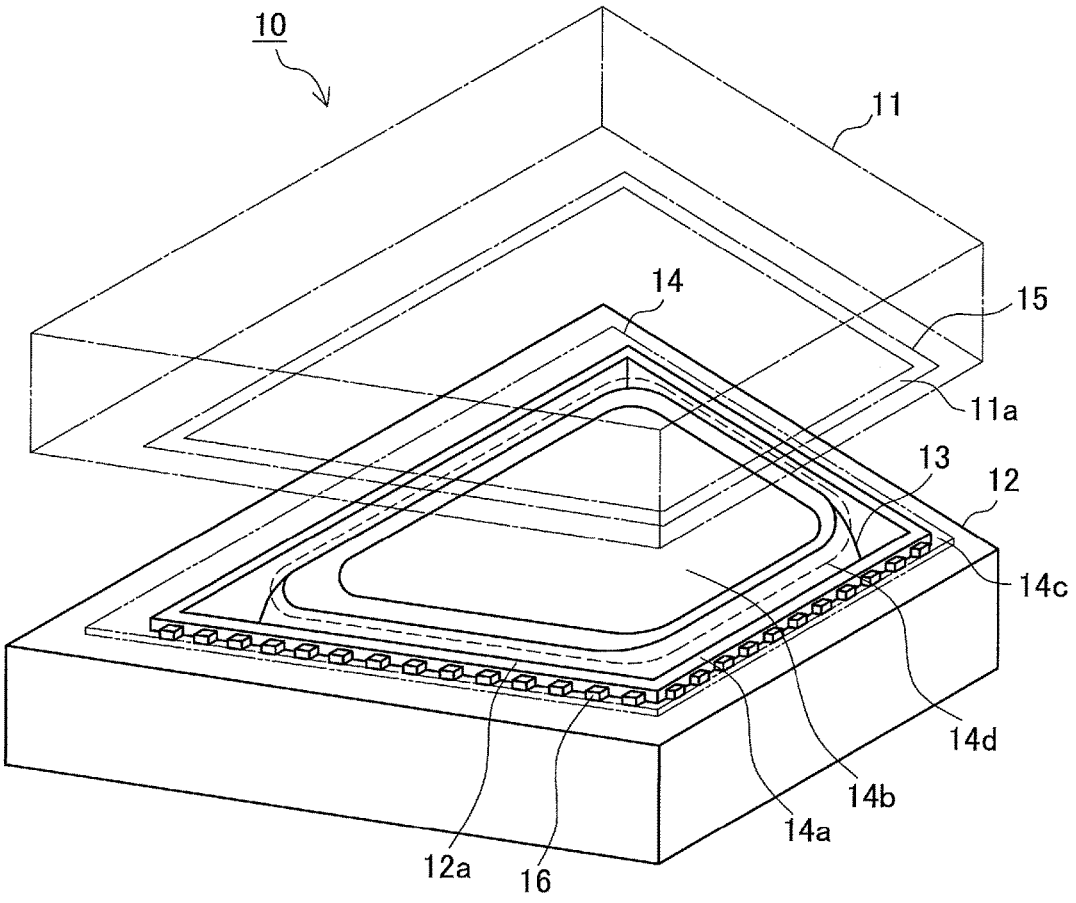
FIG. 1 is a perspective view for explaining a configuration of a manufacturing apparatus for a stretch-formed product according to an embodiment of the present invention.

Hereinafter, (a) preferred embodiment(s) of the present invention will be described in detail with reference to the appended drawings. In this specification and the appended drawings, structural elements that have substantially the same function and structure are denoted with the same reference numerals, and repeated explanation of these structural elements is omitted. Although in the following description, description will be made by taking a case where the stretch-formed product is a door outer panel by way of example, the stretch-formed product is not limited to the door outer panel. The present invention is equally applied also to other stretch-formed products such as a hood outer panel and a roof panel.

<1. Manufacturing Apparatus for Stretch-Formed Product>

FIG. 1 is a schematic explanatory diagram showing a configuration of a manufacturing apparatus 10 for a stretch-formed product according to the present embodiment. FIG. 1 is a perspective view showing the manufacturing apparatus 10 by partially omitting and simplifying it. As shown in FIG. 1, the manufacturing apparatus 10 has a die 11, a blank holder 12, and a punch 13. In FIG. 1, the contour of a blank 14 is shown by a two-dot chain line.

(1-1. Basic Configuration)

The die 11 has a clamping surface 11*a* which clamps the blank 14. The clamping surface 11*a* has a punch containing part in which the punch 13 is to be contained when forming, and a wedge-shaped bead 15 which is provided along the outside of a margin of the blank 14. The wedge-shaped bead 15 is one form of the lock bead. In order to make the drawing easily visible, in FIG. 1, the die 11 and the wedge-shaped bead 15 are shown by being simplified by a one-dot chain line. Details of the wedge-shaped bead 15 will be described later with reference to FIG. 2. In addition, the punch containing part is omitted in FIG. 1.

The blank 14 is located at the center and has a forming region 14*b* corresponding to a part which will become a product (in the example in FIG. 1, a rear door outer panel), a clamp target part 14*a* to be clamped by the die 11 and the blank holder 12 and a trim line 14*d*. The clamp target part 14*a* and the outer peripheral part 14*c* are cut off along the trim line 14*d* and are discarded. Incidentally, in FIG. 1, the trim line 14*d* is omitted.

The wedge-shaped bead 15 may be arranged on the entire circumference of the blank 14. Alternatively, in a case where a part to be subjected to drawing which involves material flowing-in and a part to be subjected to stretch forming which does not involve material flowing-in are present on the blank 14, the wedge-shaped bead 15 may be arranged only on the part to be subjected to the stretch forming. In this case, various types of known draw beads for the drawing can be provided on the part to be subjected to the drawing.

The blank holder 12 is arranged so as to face the die 11. The blank holder 12 has the punch containing part in which the punch 13 is contained, and the clamping surface 12*a* which clamps the blank 14 in cooperation with the clamping surface 11*a* of the die 11. A wedge-shaped bead 16 is provided on the clamping surface 12*a* along the margin of the blank 14. The wedge-shaped bead 16 is arranged at a position corresponding to the wedge-shaped bead 15 provided on the die 11. Details of the wedge-shaped bead 16 will be described later with reference to FIG. 2.

The punch 13 is arranged in the punch containing part of the blank holder 12 so as to face the punch containing part of the die 11. The punch 13 is relatively pressed into the die 11 at the time of forming. Thereby, the forming region 14*b* of the blank 14 is stretch-formed and the forming region 14*b* is formed into the door outer panel.

Since the materials and functions of the die 11, the blank holder 12 and the punch 13 may be the same as the materials and functions which are known as those of dies, blank holders and punches of this type, and are well known to a person skilled in the art, further description on the die 11, the blank holder 12 and the punch 13 is omitted.

(1-2. Lock Bead (Wedge-Shaped Bead))

The wedge-shaped bead 15 to be provided on the die 11 and the wedge-shaped bead 16 to be provided on the blank holder 12 are provided so as to mutually correspond to each other in position and shape. When forming, the clamp target part 14*a* of the blank 14 is nipped and held, and clamped by the wedge-shaped beads 15 and 16 such that the blank 14 does not flow into the forming region 14*b*.

Figure 2:
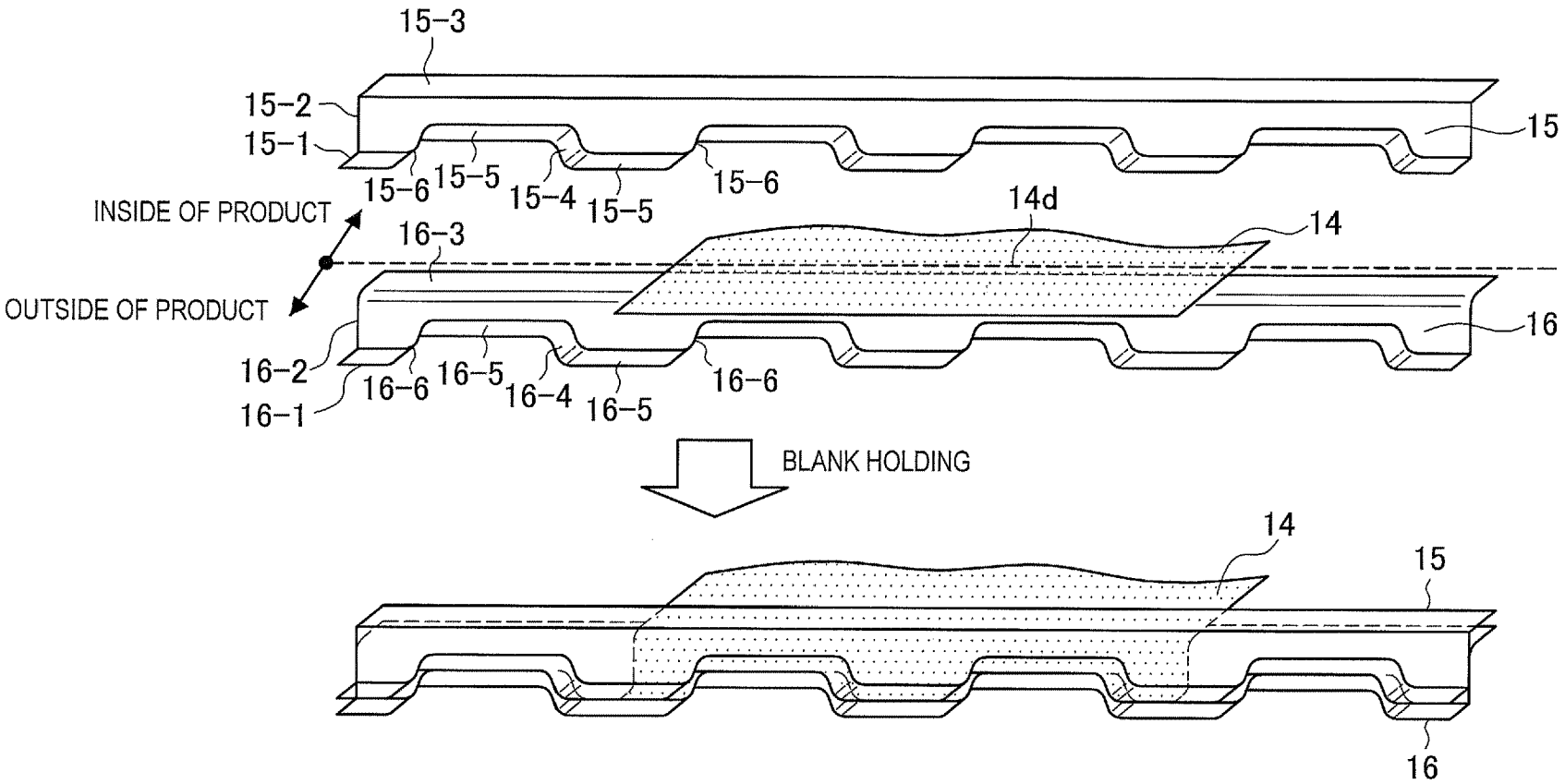
FIG. 2 is a perspective view showing states before and after clamping a blank by lock beads according to the embodiment.
Figure 3:
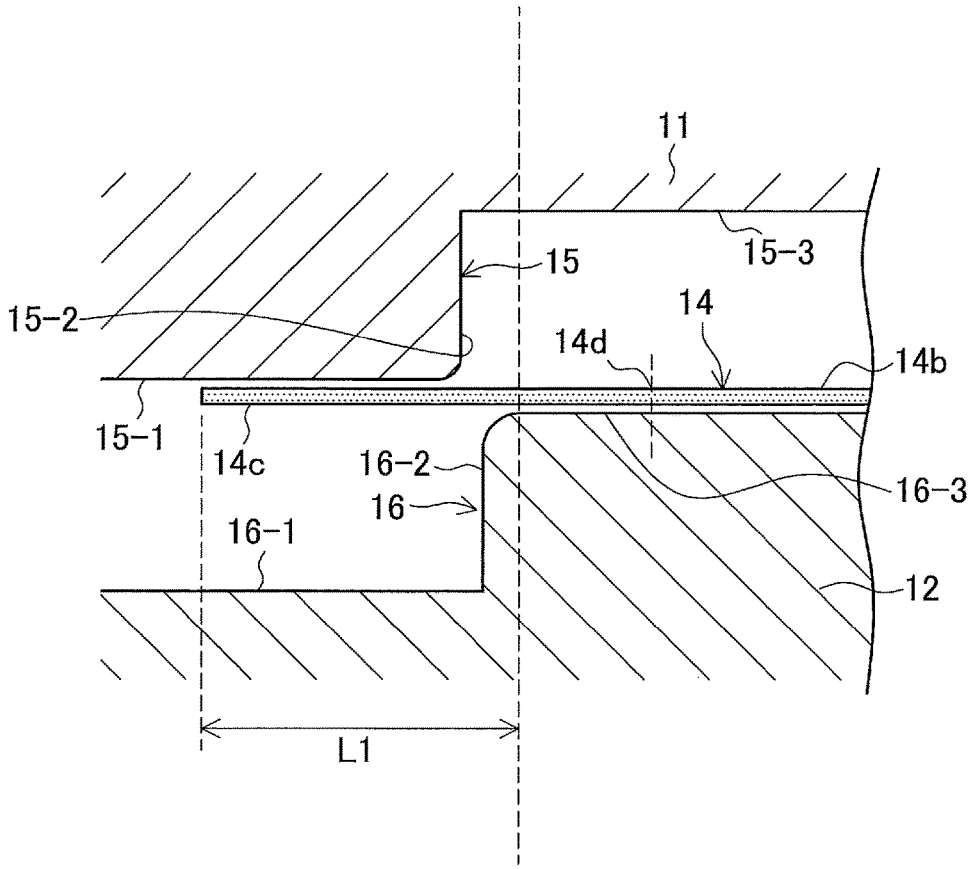
FIG. 3 is a sectional view showing the lock beads, an outer peripheral part of the blank and a trim line.
Figure 4:
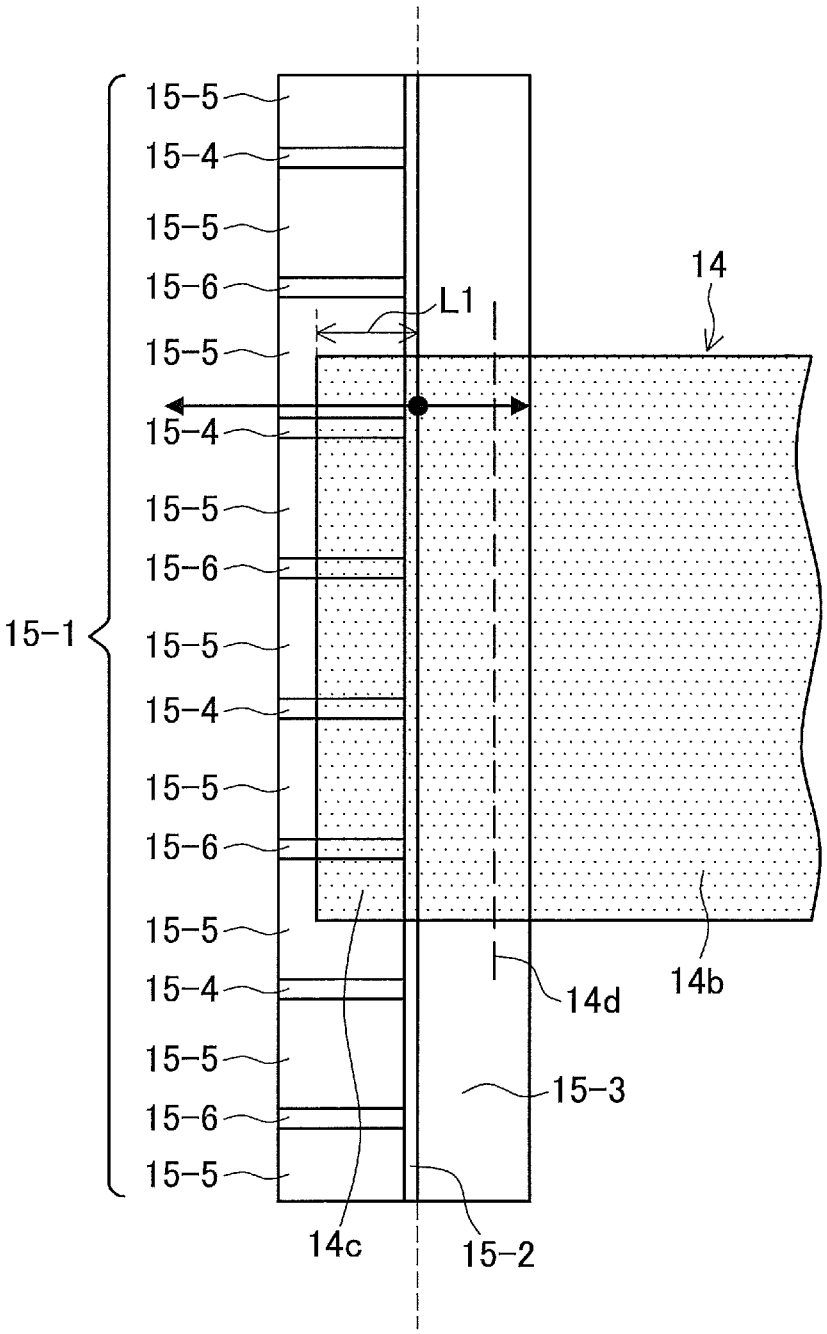
FIG. 4 is a top view showing the lock beads, the outer peripheral part of the blank and the trim line.

FIG. 2 to FIG. 4 are explanatory diagrams showing the states of the wedge-shaped beads 15 and 16 at the time of stretch forming. FIG. 2 is a perspective view showing the states before and after clamping the blank 14. FIG. 3 is a sectional view showing the wedge-shaped beads 15 and 16, and the outer peripheral part 14*c* and the trim line 14*d* of the blank 14. FIG. 4 is a top view showing the wedge-shaped bead 15, and the outer peripheral part 14*c* and the trim line 14*d* of the blank 14. A region of the length L1 is a part to be clamped by the wedge-shaped beads 15 and 16 and to be discarded in most cases.

Incidentally, in the following description, the wedge-shaped bead 15 provided on the die 11 will be mainly described. Since the wedge-shaped bead 16 provided on the blank holder 12 corresponds to the wedge-shaped bead 15 in position and shape, it can be understood by reading it through appropriate alteration.

As shown in FIG. 2 and FIG. 3, the wedge-shaped bead 15 has a stepped shape including a first surface 15-1, a second surface 15-2 and a third surface 15-3 from the outer edge toward the center of the die 11 (from the left side to the right side in FIG. 3). That is, the first surface 15-1, the second surface 15-2 and the third surface 15-3 make a step from the outer edges toward the centers of the blank holder 12 and the die 11. The second surface 15-2 intersects with (in the shown example, is orthogonal to) the first surface 15-1. The third surface 15-3 intersects with (in the shown example, is orthogonal to) the second surface 15-2.

As shown in FIG. 2 and FIG. 4, the first surface 15-1 of the wedge-shaped bead 15 has a plurality of depression-protrusion parts each configured by a fourth surface 15-4, a fifth surface 15-5 and a sixth surface 15-6. The fifth surface 15-5 intersects with the fourth surface 15-4. The sixth surface 15-6 intersects with the fifth surface 15-5 and faces the fourth surface 15-4. That is, the fourth surface 15-4 and the sixth surface 15-6 face each other.

The fourth surface 15-4, the fifth surface 15-5 and the sixth surface 15-6 are continuously formed in order of the fourth surface 15-4, the fifth surface 15-5, the sixth surface 15-6 and the fifth surface 15-5 in an extending direction of the wedge-shaped bead 15, that is in the direction orthogonal to a direction going from the outer edge toward the center of the die 11. Thereby, depressed and protruded shapes are alternately arrayed on the first surface 15-1 in the extending direction of the wedge-shaped bead 15. In a section parallel to the second surface 15-2, the fourth surface 15-4, the fifth surface 15-5 and the sixth surface 15-6 of the wedge-shaped bead 15 form three sides of a substantial quadrilateral. Although they make three sides of a trapezoid in the shown example, they may make three sides of a rectangle.

The height and pitch of this quadrilateral, the rising angles of the fourth surface 15-4 and the sixth surface 15-6, and the radius of curvature of a corner part that the fourth surface 15-4 or the sixth surface 15-6 and the fifth surface 15-5 make can be appropriately set. However, when the height of the quadrilateral is too low or the pitch is too large, it becomes difficult to obtain an effect of increasing the deformation resistance (hereinafter, also referred to as the "unbending deformation resistance") caused when the depressed and protruded shapes are unbent to planar shapes, and the blank clamping force is lowered in some cases. Meanwhile, when the height of the quadrilateral is too high, it is feared that the blank 14 may be destroyed when clamping the blank 14. Meanwhile, when the rising angles of the fourth surface 15-4 and the sixth surface 15-6 are too small, it becomes difficult to obtain the effect of increasing the unbending deformation resistance, and the blank clamping force is lowered in some cases.

By taking these points into consideration, in a case where the wedge-shaped bead 15 having a quadrilateral wedge shape (a trapezoidal one and a rectangular one are included) is to be formed, it is preferable that an interval per pitch that a protruded shape and a depressed shape of the quadrilateral are defined as one set be within a range of 5 to 50 mm and the height of the quadrilateral be within a range of 1.0 to 10.0 mm. Incidentally, the pitch interval in a case of the trapezoidal wedge shape and so forth means a pitch interval when a set of the protruded shape and the depressed shape of the trapezoid is defined as one pitch with a position where the height of the trapezoid is ½ being set as a reference.

In addition, when in relation to the height of the second surface 15-2, a level difference between the third surface 15-3 and the fifth surface 15-5 is too small, bending deformation of the blank 14 on the depression-protrusion part and bending deformation at the boundary between the second surface 15-2 and the third surface 15-3 cannot be individually generated and it is feared that the effect of increasing the unbending deformation resistance may not be obtained. In addition, when the level difference is too large, it is feared that the material yield of the blank 14 may be lowered. Accordingly, it is preferable that the level difference be within a range of 1.5 to 8.0 mm.

A fourth surface 16-4, a fifth surface 16-5 and a sixth surface 16-6 of the wedge-shaped bead 16 provided on the blank holder 12 are arranged at positions respectively corresponding to the fourth surface 15-4, the fifth surface 15-5 and the sixth surface 15-6 of the wedge-shaped bead 15 provided on the die 11. Accordingly, in a state of clamping the blank 14 by the die 11 and the blank holder 12, the fourth surface 15-4, the fifth surface 15-5 and the sixth surface 15-6 of the wedge-shaped bead 15 respectively face the fourth surface 16-4, the fifth surface 16-5 and the sixth surface 16-6 of the wedge-shaped bead 16 via the blank 14.

Incidentally, although in the above description, a case where the wedge-shaped bead 15, 16 has a stepped shape in which the first surface 15-1, 16-1 is located lower than the third surface 15-3, 16-3 has been taken by way of example, the stepped shape may be reversed. That is, the wedge-shaped bead 15, 16 may have a stepped shape in which the first surface 15-1, 16-1 is located higher than the third surface 15-3, 16-3.

(1-3. Modified Examples of Lock Bead (Wedge-Shaped Bead))

Figure 5:
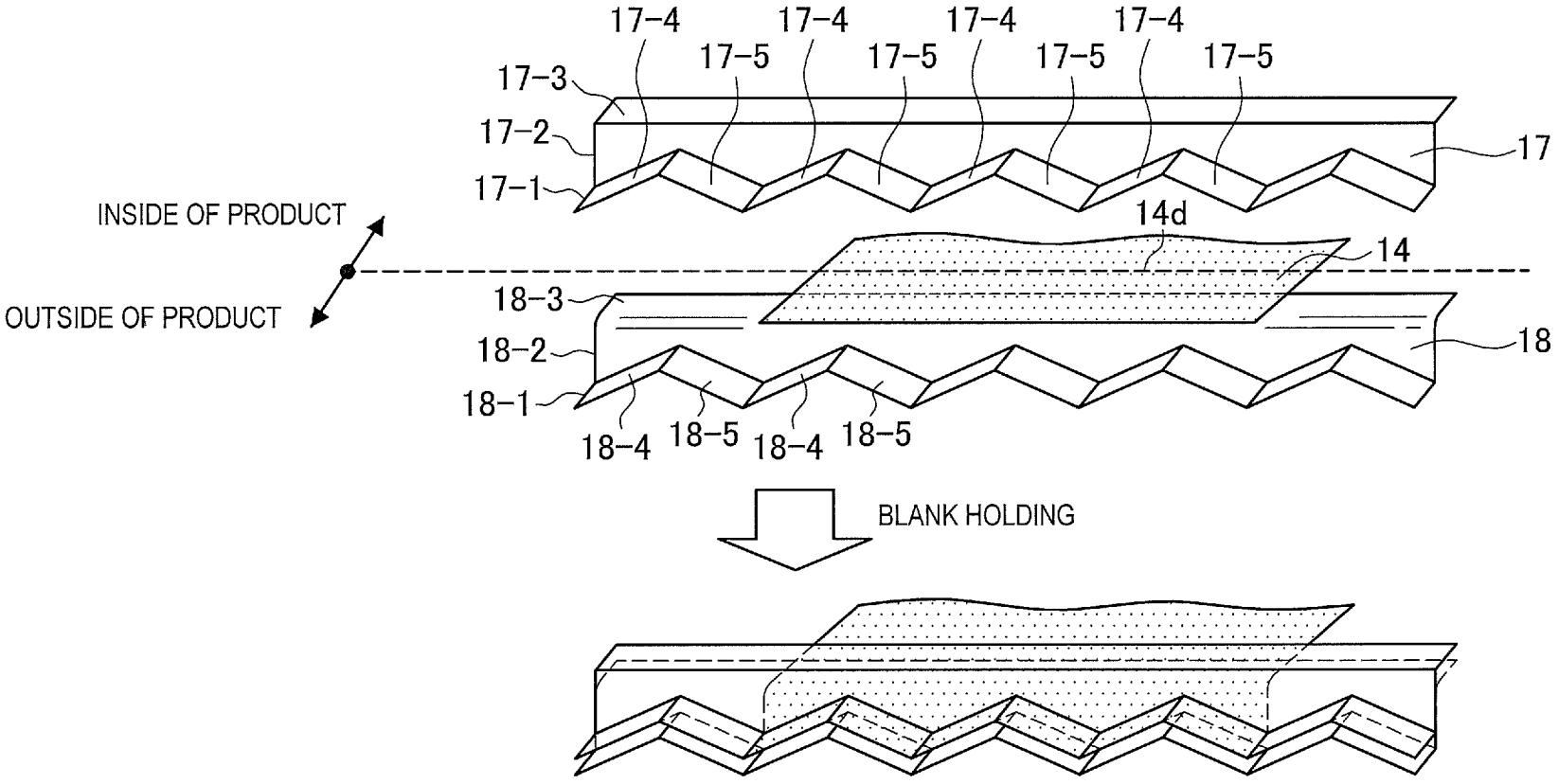
FIG. 5 is a perspective view showing states before and after clamping the blank by other lock beads.
Figure 6:
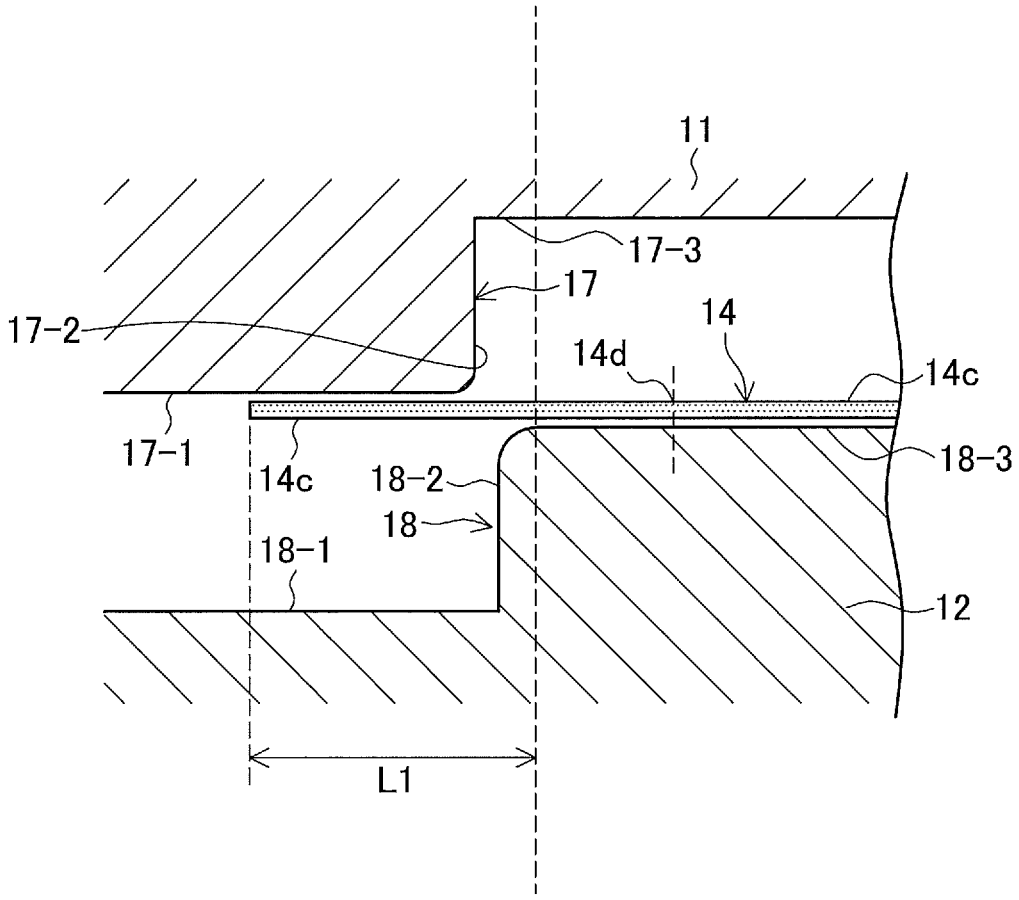
FIG. 6 is a sectional view showing the other lock beads, the outer peripheral part of the blank and the trim line.
Figure 7:
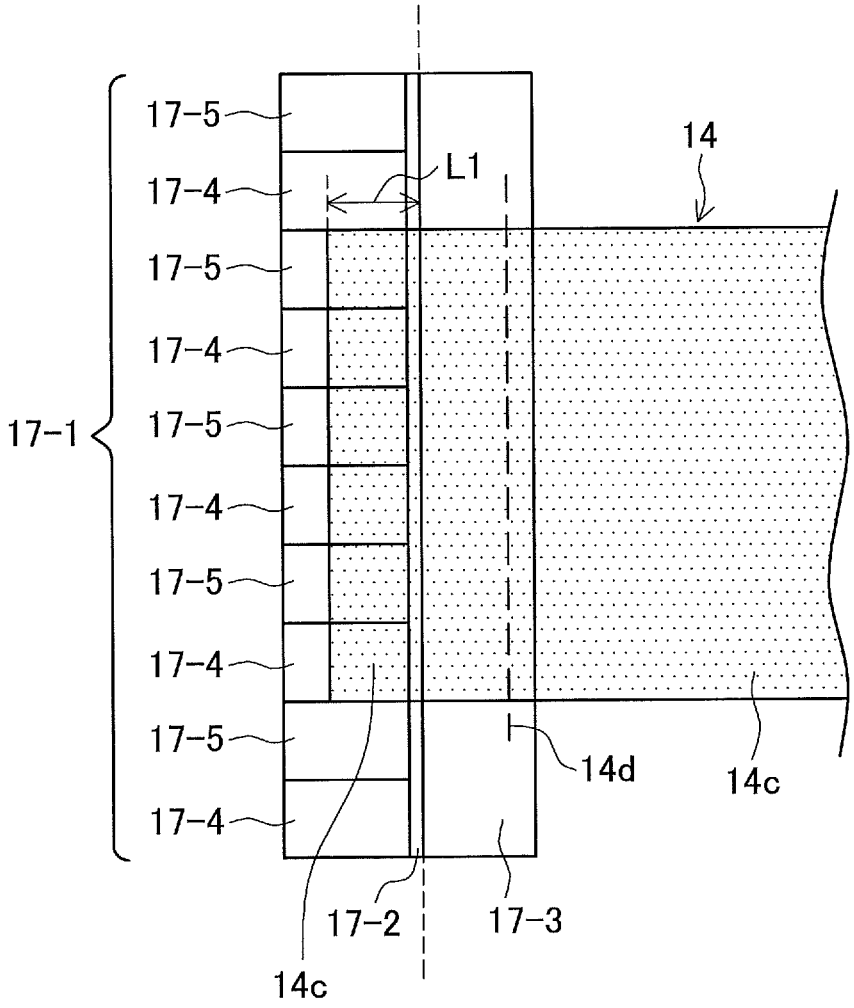
FIG. 7 is a top view showing the other lock beads, the outer peripheral part of the blank and the trim line.

FIG. 5 to FIG. 7 are explanatory diagrams showing other wedge-shaped beads 17 and 18 used in the stretch forming as a modified example of the lock bead. FIG. 5 is a perspective view showing the states before and after clamping the blank 14. FIG. 6 is a sectional view showing the wedge-shaped beads 17 and 18, and the outer peripheral part 14*c* and the trim line 14*d* of the blank 14. FIG. 7 is a top view showing the wedge-shaped bead 17, and the outer peripheral part 14*c* and the trim line 14*d* of the blank 14. A region of the length L1 is a part to be clamped by the wedge-shaped beads 17 and 18 and to be discarded in most cases.

Incidentally, similarly to the above description, the wedge-shaped bead 17 provided on the die 11 will be mainly described later. Since the wedge-shaped bead 18 provided on the blank holder 12 also corresponds to the wedge-shaped bead 17 in position and shape in this example, it can be understood by reading it through appropriate alteration.

As shown in FIG. 5 and FIG. 6, the wedge-shaped bead 17 has a stepped shape including a first surface 17-1, a second surface 17-2 and a third surface 17-3 from the outer edge toward the center of the die 11 (from the left side to the right side in FIG. 6). That is, the first surface 17-1, the second surface 17-2 and the third surface 17-3 make a step from the outer edges toward the centers of the blank holder 12 and the die 11. The second surface 17-2 intersects with (in the shown example, is orthogonal to) the first surface 17-1. The third surface 17-3 intersects with (in the shown example, is orthogonal to) the second surface 17-2.

As shown in FIG. 5 and FIG. 7, the first surface 17-1 of the wedge-shaped bead 17 has a plurality of depression-protrusion parts in which a fourth surface 17-4 and a fifth surface 17-5 are alternately and continuously formed in an extending direction of the wedge-shaped bead 17, that is in the direction orthogonal to the direction going from the outer edge toward the center of the die 11. Thereby, depressed and protruded shapes are alternately arrayed on the first surface 17-1 in the extending direction of the wedge-shaped bead 17. In a section parallel to the second surface 17-2, the fourth surface 17-4 and the fifth surface 17-5 of the wedge-shaped bead 17 form two sides of a triangle.

The height and pitch of this triangle, the rising angles of the fourth surface 17-4 and the fifth surface 17-5, and the radius of curvature of a corner part that the fourth surface 17-4 and the fifth surface 17-5 make can be appropriately set. However, when the height of the triangle is too low or the pitch is too large, it becomes difficult to obtain the effect of increasing the unbending deformation resistance, and the blank clamping force is lowered in some cases. Meanwhile, when the rising angles of the fourth surface 17-4 and the fifth surface 17-5 are too small, the pitch of the triangle becomes large, and consequently it becomes difficult to obtain the effect of increasing the unbending deformation resistance and the blank clamping force is lowered in some cases. Meanwhile, when the rising angles of the fourth surface 17-4 and the fifth surface 17-5 are large and the height of the triangle becomes too high, it is feared that the blank 14 may be destroyed when clamping the blank 14 and wrinkles may be generated on the blank 14.

By taking these points into consideration, in a case where the wedge-shaped bead 17 having a triangular wedge shape is to be formed, it is preferable that a pitch interval of the triangle be within a range of 5 to 50 mm and the rising angles of the fourth surface 17-4 and the fifth surface 17-5 be within a range of 10 to 40 degrees. Incidentally, the pitch interval in a case of the triangular wedge shape means the length of the base of the triangle.

In addition, when in relation to the height of the second surface 17-2, a level difference between the third surface 17-3 and the apex of the triangle is too small, bending deformation of the blank 14 on the depression-protrusion part and bending deformation at the boundary between the second surface 17-2 and the third surface 17-3 cannot be individually generated and it is feared that the effect of increasing the unbending deformation resistance may not be obtained. In addition, when the level difference is too large, it is feared that the material yield of the blank 14 may be lowered. Accordingly, it is preferable that the level difference be within a range of 1.5 to 8.0 mm.

A fourth surface 18-4 and a fifth surface 18-5 of the wedge-shaped bead 18 provided on the blank holder 12 are arranged at positions respectively corresponding to the fourth surface 17-4 and the fifth surface 17-5 of the wedge-shaped bead 17 provided on the die 11. Accordingly, in a state of clamping the blank 14 by the die 11 and the blank holder 12, the fourth surface 18-4 and the fifth surface 18-5 of the wedge-shaped bead 18 respectively face the fourth surface 17-4 and the fifth surface 17-5 of the wedge-shaped bead 17 via the blank 14.

Incidentally, although in the above description, a case where the wedge-shaped bead 17, 18 has a stepped shape in which the first surface 17-1, 18-1 is located lower than the third surface 17-3, 18-3 has been taken by way of example, the stepped shape may be reversed. That is, the wedge-shaped bead 17, 18 may have a stepped shape in which the first surface 17-1, 18-1 is located higher than the third surface 17-3, 18-3.

<2. Manufacturing Method for Stretch-Formed Product>

Next, a manufacturing method for a stretch-formed product using the manufacturing apparatus for a stretch-formed product according to the present embodiment will be described together with an action of the lock bead. In the following example, description will be made with reference to FIG. 1 to FIG. 4 as appropriate by taking a case where the die 11 and the blank holder 12 are respectively provided with the wedge-shaped beads 15 and 16 shown in FIG. 2 to FIG. 4 by way of example. Also a case where the die 11 and the blank holder 12 are respectively provided with the wedge-shaped beads 17 and 18 shown in FIG. 5 to FIG. 7 is understood similarly.

In the manufacturing method for a stretch-formed product according to the present embodiment, a known process of the stretch forming can be adopted as the entire process of the stretch forming. Briefly describing, first, the blank 14 is aligned and placed on the blank holder 12. Then, the margin of the blank 14 is clamped by the clamping surfaces 11*a* and 12*a* of the die 11 and the blank holder 12 on which the wedge-shaped beads 15 and 16 are provided by relatively moving the die 11 toward the blank holder 12.

The forming region 14*b* located at the center of the blank 14 is relatively pressed toward the die 11 by relatively moving the punch 13 toward the die 11 in this state. At this time, the clamp target part 14*a* of the blank 14 is clamped by the wedge-shaped beads 15 and 16 provided on the clamping surfaces 11*a* and 12*a* such that the blank 14 does not flow from the outer edge part of the blank 14 toward the forming region 14*b*. Thereby, the stretch-formed product with no flowing of the blank 14 into the forming region 14*b* is formed.

At this time, when clamping the blank 14, for example, a load which is about 200 t as a whole becomes necessary in some cases. Accordingly, a clamping function by the wedge-shaped beads 15 and 16 becomes important in order to prevent flowing of the blank 14 into the forming region 14*b* even while clamping the blank 14 by applying a large load.

In the present embodiment, as shown in FIG. 2 to FIG. 4, the wedge-shaped bead 15, 16 has a stepped shape formed by the first surface 15-1, 16-1, the second surface 15-2, 16-2 and the third surface 15-3, 16-3 from the outer edge toward the center of each of the die 11 and the blank holder 12. The second surface 15-2, 16-2 intersects with the first surface 15-1, 16-1. The third surface 15-3, 16-3 intersects with the second surface 15-2, 16-2.

The first surface 15-1, 16-1 has the fourth surface 15-4, 16-4 and sixth surface 15-6, 16-6 facing each other in the extending direction of the wedge-shaped bead 15, 16. Further, the first surface 15-1, 16-1 has the fifth surface 15-5, 16-5 which is arranged between the fourth surface 15-4, 16-4 and the sixth surface 15-6, 16-6 and intersects with the fourth surface 15-4, 16-4 and the sixth surface 15-6, 16-6.

By configuring the wedge-shaped beads 15 and 16 in this way, the clamp target part 14*a* of the blank 14 which is clamped by the wedge-shaped beads 15 and 16 becomes non-linear in section in a direction orthogonal to a direction going from the outer edge part toward the forming region 14*b* of the blank 14. Thereby, the bending rigidity of the blank 14 clamped by the wedge-shaped beads 15 and 16 is improved and the unbending resistance when the blank 14 is about to flow toward the forming region 14*b* becomes large.

In addition, on the clamp target part 14*a* of the blank 14, in a corner part corresponding to the boundary portion between the first surface 15-1, 16-1 and the second surface 15-2, 16-2 of the wedge-shaped bead 15, 16, the length of a part which becomes non-parallel to a corner part corresponding to the boundary portion between the second surface 15-2, 16-2 and the third surface 15-3, 16-3 of the wedge-shaped bead 15, 16 becomes long. Thereby, the unbending resistance when the blank 14 is about to flow toward the forming region 14*b* becomes large similarly.

Accordingly, in cooperation with the deformation resistances of bending and unbending deformation at the corner part of the step which is formed by the first surface 15-1, 16-1, the second surface 15-2, 16-2 and the third surface 15-3, 16-3 of the wedge-shaped bead 15, 16 and the frictional resistances of the wedge-shaped bead 15, 16 with the blank 14, flowing of the blank 14 from the outer peripheral part 14*c* into the forming region 14*b* of the blank 14 can be effectively prevented.

Accordingly, even in a case where the pressing length L1 by the wedge-shaped beads 15 and 16 along the direction going from the outer peripheral part 14*c* toward the forming region 14*b* of the blank 14 is made short, the blank clamping force required for the stretch forming is ensured. In the present embodiment, the material yield of the blank 14 can be improved by the amount that the pressing length L1 by the wedge-shaped beads 15 and 16 in the blank 14 can be shortened in this way.

EXAMPLES

In the following, Examples of the present invention will be described.

(Evaluation 1)

In the Evaluation 1, a blank clamping performance (a blank locking force) of each bead was evaluated in accordance with a later described test procedure by using a material sliding test device which is equipped with a blank clamping part having the beads of each form formed on the die and the blank holder. The blank (a test material) used is an alloyed hot dip galvanized steel sheet which is 0.7 mm in sheet thickness and is at the 340 MPa level in tensile strength measured by a tensile test based on JIS Z 2241.

In an Example 1, the blank clamping performance (the blank locking performance) of the wedge-shaped beads 15 and 16 was evaluated by using the material sliding test device which is equipped with the blank clamping part in which the wedge-shaped beads 15 and 16 shown in FIG. 2 to FIG. 4 had been formed. In an Example 2, the blank clamping performance of the wedge-shaped beads 17 and 18 was evaluated similarly to the Example 1 except that a material sliding test device which is equipped with a blank clamping part in which the wedge-shaped beads 17 and 18 shown in FIG. 5 to FIG. 7 had been formed is used.

Figure 15:
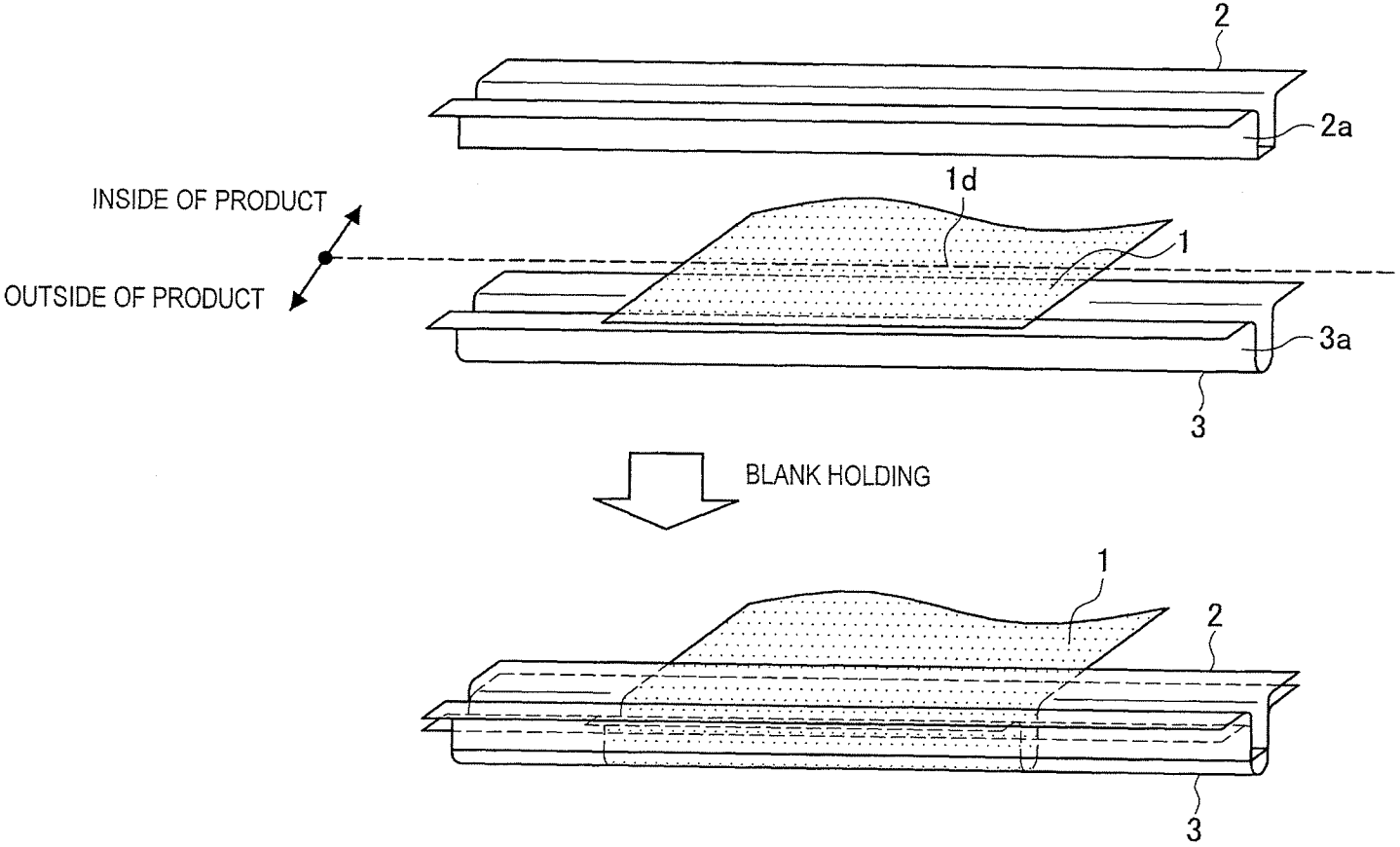
FIG.15 CONVENTIONAL ART
FIG. 15 is a perspective view showing states before and after clamping the blank in the stretch forming using a die provided with conventional trapezoidal beads.
Figure 16:
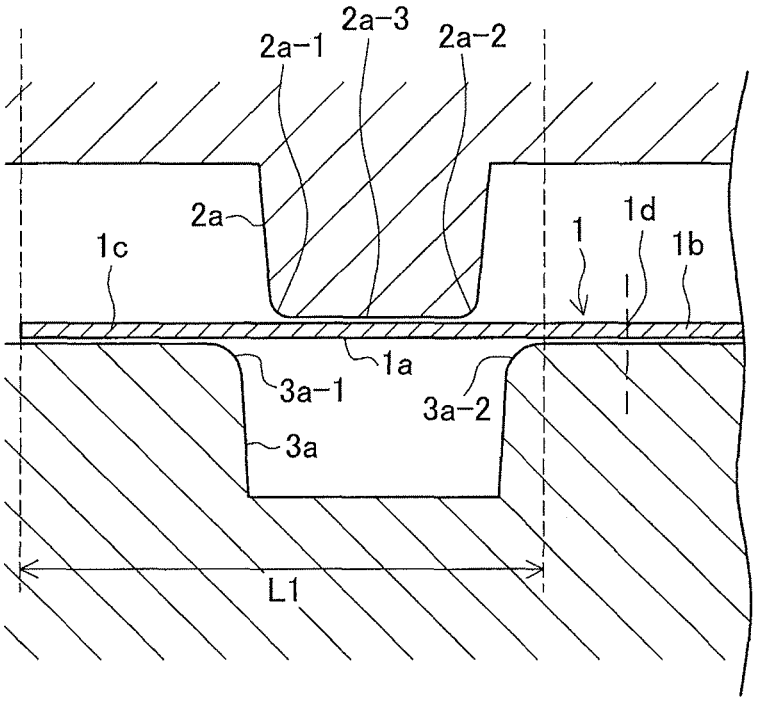
FIG.16 CONVENTIONAL ART
FIG. 16 is a sectional view showing the vicinity of the conventional trapezoidal beads.
Figure 17:
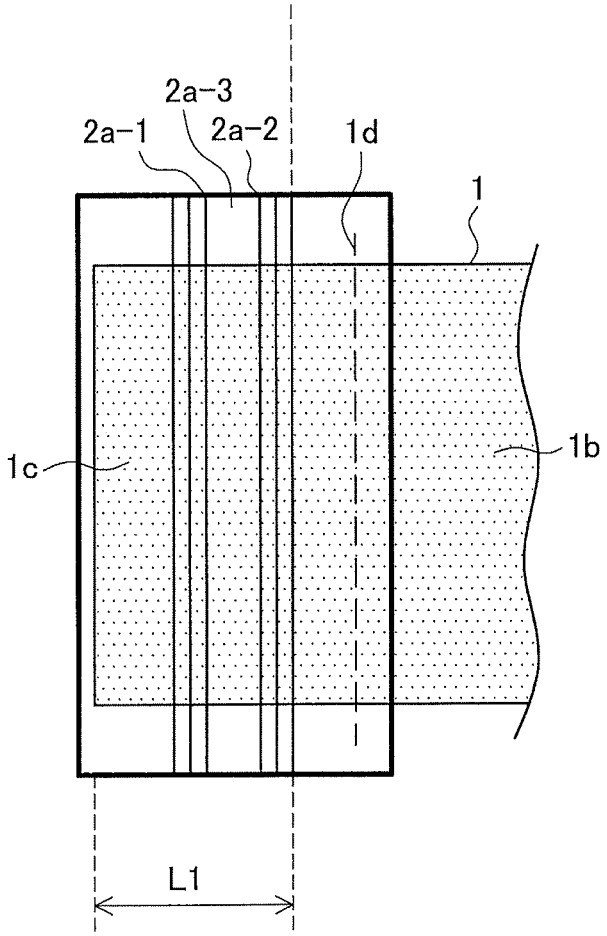
FIG.17 CONVENTIONAL ART
FIG. 17 is a top view showing the vicinity of the conventional trapezoidal beads.

In a Comparative example 1, the blank clamping performance of the trapezoidal beads 2*a* and 3*a* was evaluated similarly to the Example 1 except that a material sliding test device which is equipped with a blank clamping part in which the conventional trapezoidal beads 2*a* and 3*a* shown in FIG. 15 to FIG. 17 had been formed is used. In addition, in a Comparative example 2, the blank clamping performance of stepped beads was evaluated similarly to the Example 1 except that a material sliding test device which is equipped with a blank clamping part in which the stepped beads constituted by only stepped shapes that the first surfaces 15-1, 16-1, 17-1, and 18-1 in FIG. 2 and FIG. 5 are flattened had been formed is used.

[Test Procedure]

Figure 8:
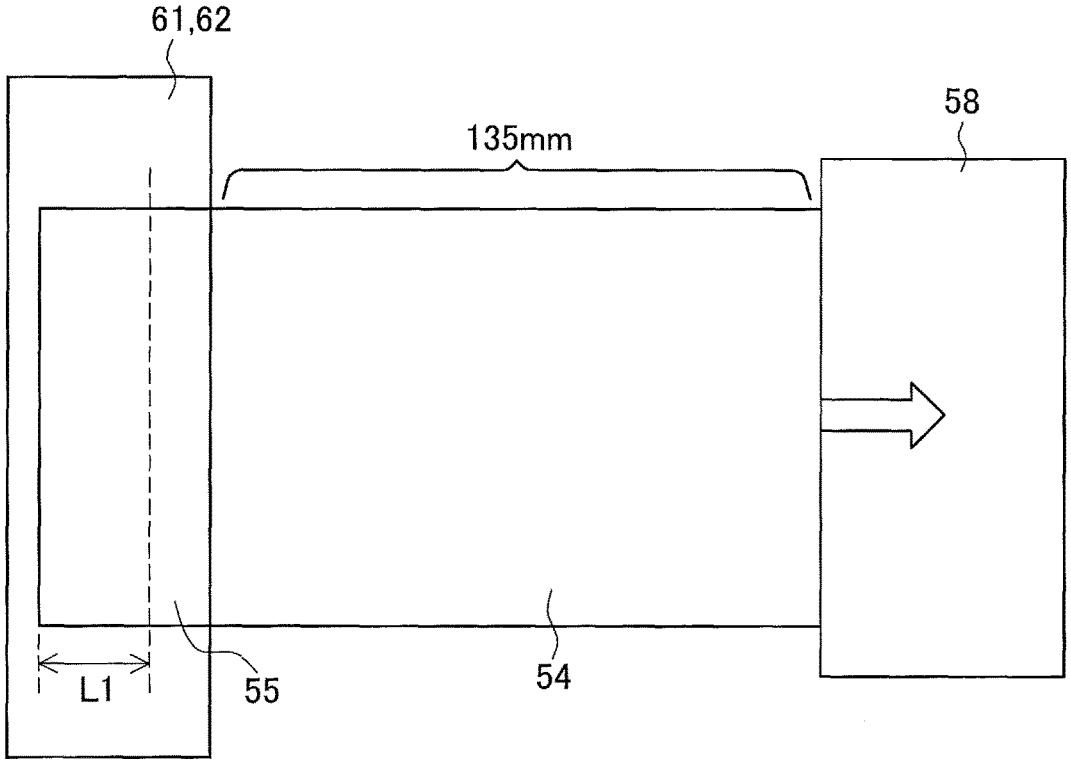
FIG. 8 is an explanatory diagram showing a test procedure of an Evaluation 1 in an Example.

As shown in FIG. 8, a blank 54 of 60 mm in sheet width is clamped by a die 61 and a blank holder 62 of each manufacturing apparatus with pressing force per unit length along the extending direction of the bead being set to 30 kgf/mm. The pressing length L1 of the blank 54 which is clamped by clamping surfaces of the die 61 and the blank holder 62 was set as follows.

Example 1 (the wedge-shaped beads): L1=9.5 mm

Example 2 (the wedge-shaped beads): L1=9.0 mm

Comparative example 1 (the trapezoidal beads): L1=19.0 mm

Comparative example 2 (the stepped beads): L1=9.0 mm

The blank 54 is nipped and held by a chuck 58 at a position where the length up to an end of a clamp target part 55 to be clamped by the clamping surfaces of the die 61 and the blank holder 62 having the respective beads reaches 135 mm. The chuck 58 is moved from this state and the blank 54 is drawn out of the die 61 and the blank holder 62. In that occasion, the test was performed a plurality of times by changing a drawing-out length in a variety of ways and a flowing-in length was evaluated from a sliding mark generated on the blank 54 after each test.

Figure 9:
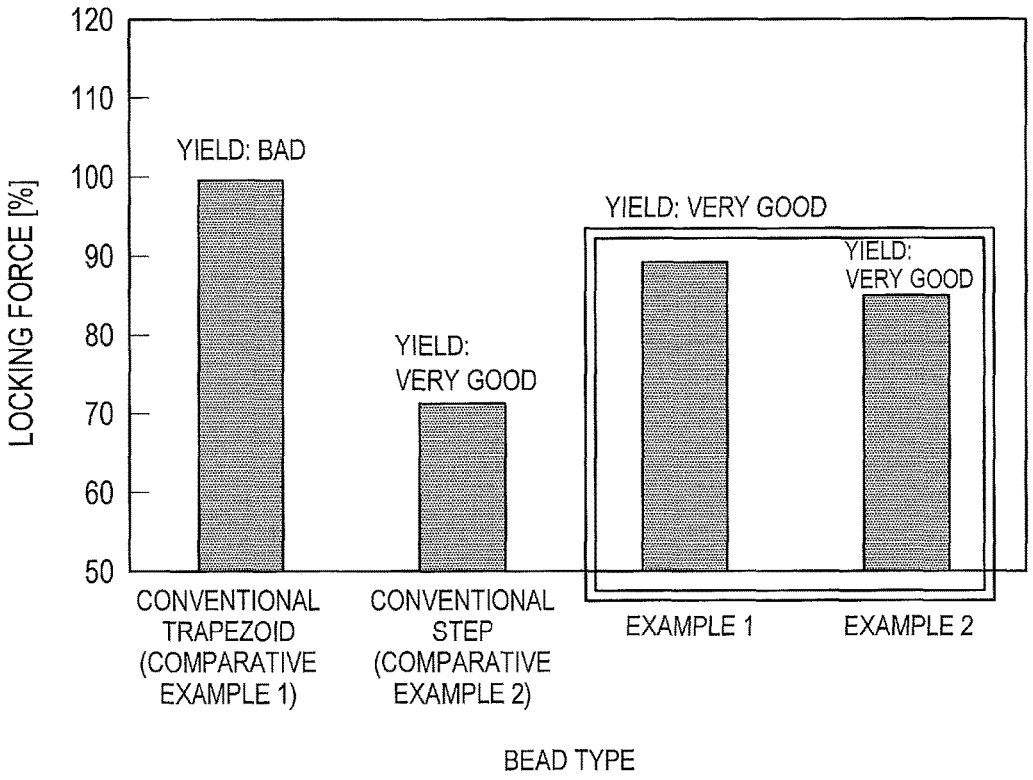
FIG. 9 is a graph showing a result of the Evaluation 1 in the Example.

Here, time when the flowing-in length reaches about 1 mm was defined as a lock limit, that is, as a malfunction as the lock bead. Then, drawing-out force at the lock limit (the flowing-in length=1 mm), that is, the locking force was calculated and evaluated by interpolating "data on drawing-out force–flowing-in length" obtained in the above-mentioned tests. FIG. 9 is a graph showing a result of the evaluations. In FIG. 9, the locking force is indicated by a relative value with the locking force of the conventional trapezoidal beads 2*a* and 3*a* being set as 100%.

As shown in FIG. 9, although the trapezoidal beads 2*a* and 3*a* in the Comparative example 1 exhibit a high locking force, the pressing length L1 by the die and the blank holder is 19.0 mm and it is difficult to miniaturize the blank 54 by shortening the pressing length L1. Accordingly, the Comparative example 1 is low in material yield of the blank 54. In addition, although the stepped bead in the Comparative example 2 is 9.0 mm in pressing length L1 and it is possible to shorten the pressing length L1, the locking force is about 70%. Accordingly, the Comparative example 2 cannot ensure the locking force required for the stretch forming.

In contrast thereto, the wedge-shaped beads 15, 16, 17, and 18 in the Examples 1 and 2 are individually 9.5 mm and 9.0 mm in pressing length L1, it is possible to shorten the pressing lengths L1 thereof equally to the Comparative example 2 and the locking forces thereof reach 89% and 85% individually. In particular, since the wedge-shaped bead in the Example 1 has the sixth surface together with the fourth surface and the fifth surface, the locking force which is higher than that of the wedge-shaped bead in the Example 2 was ensured. The wedge-shaped beads 15, 16, 17, and 18 in the Examples 1 and 2 exhibit high locking performances required for the stretch forming in this way. In addition, since the wedge-shaped beads 15, 16, 17, and 18 in the Examples 1 and 2 can reduce the pressing lengths L1 much more than the conventional trapezoidal beads, the yield of material of the blank 54 can be improved much better.

(Evaluation 2)

In the Evaluation 2, the blank clamping performance (the blank locking force), the material yield, the appearance of the clamp target part and the influence on a product surface were each evaluated by drawing out the blank by using the chuck similarly to the Evaluation 1, while changing the shapes of the wedge-shaped beads 15 and 16 shown in FIG. 2 to FIG. 4 and the wedge-shaped beads 17 and 18 shown in FIG. 5 to FIG. 7. The blank (the test material) used is the alloyed hot dip galvanized steel sheet which is 0.7 mm in sheet thickness and is the 340 MPa level in tensile strength measured in the tensile test based on JIS Z 2241 similarly to the Evaluation 1. Table 1 indicates the shapes of the wedge-shaped beads and evaluation results. Examples 3 to 9 and Comparative examples 3 to 7 pertain to the wedge-shaped beads 15 and 16 which have a trapezoidal wedge shape (a square is included) and Examples 10 to 14 and Comparative examples 8 to 12 pertain to the wedge-shaped beads 17 and 18 which have a triangular wedge shape.

TABLE 1

| | Shape | | | | | | Evaluation | | | |
|---|---|---|---|---|---|---|---|---|---|---|
| | | | | | | | | | Clamp | |
| | Wedge Shape | Presence/ Absence of Step | Wedge Pitch (mm) | Wedge Hight (mm) | Wedge Wall Angle (deg.) | Wedge Corner Curvature (mm) | Locking Performance | Material Yield | Target Part Appearance (Cracks and so forth) | Influence on Product Surface |
| Example 3 | Trapezoid | Present | 30 | 2.5 | 90 | 1 | good | good | good | good |
| Example 4 | | Present | 30 | 3.0 | 90 | 1 | good | good | good | good |
| Example 5 | | Present | 20 | 2.5 | 90 | 1 | good | good | good | good |
| Example 6 | | Present | 30 | 2.5 | 90 | 2 | good | good | good | good |
| Example 7 | | Present | 5 | 2.0 | 90 | 1 | good | good | good | good |
| Example 8 | | Present | 8 | 1.0 | 90 | 0.5 | good | good | good | good |
| Example 9 | | Present | 50 | 10.0 | 90 | 5 | good | good | good | good |
| Comparative example 3 | | Present | 80 | 2.5 | 90 | 1 | bad | good | good | good |
| Comparative example 4 | | Present | 30 | 0.5 | 60 | 1 | bad | good | good | good |
| Comparative example 5 | | Present | 50 | 2.5 | 15 | 1 | bad | good | good | good |
| Comparative example 6 | | Present | 30 | 20.0 | 90 | 1 | — | bad | bad | good |
| Comparative example 7 | | Absent | 50 | 2.5 | 90 | 1 | bad | good | good | bad |
| Example 10 | Triangle | Present | 10 | 3.0 | ≈34 | 1 | good | good | good | good |
| Example 11 | | Present | 20 | 3.0 | ≈17 | 1 | good | good | good | good |
| Example 12 | | Present | 10 | 1.0 | ≈12 | 0.5 | good | good | good | good |
| Example 13 | | Present | 5 | 1.5 | ≈38 | 1 | good | good | good | good |
| Example 14 | | Present | 50 | 10.0 | ≈22 | 1 | good | good | good | good |
| Comparative example 8 | | Present | 80 | 3.0 | ≈4 | 1 | bad | good | good | good |
| Comparative example 9 | | Present | 20 | 1.0 | ≈6 | 1 | bad | good | good | good |
| Comparative example 10 | | Present | 20 | 10.0 | ≈45 | 1 | — | bad | bad | good |
| Comparative example 11 | | Present | 24 | 1.0 | ≈6 | 25 | bad | good | good | good |
| Comparative example 12 | | Absent | 80 | 3.0 | ≈4 | 1 | bad | good | good | bad |

In the Comparative examples 7 and 12, "Absence of Step" indicates a form in which the second surfaces 15-2, 16-2, 17-2 and 18-2 and the third surfaces 15-3, 16-3, 17-3 and 18-3 in FIG. 2 and FIG. 5 are not provided and the wedge-shaped beads are formed on flat surfaces. The wedge pitch in a case of the trapezoidal wedge shape corresponds to the pitch interval when the set of the protruded shape and the depressed shape of the trapezoid is defined as one pitch with the position where the wedge height is ½ being set as the reference. In addition, the wedge pitch in a case of the triangular wedge shape corresponds to the length of the base of the triangle. The wedge wall angle means the rising angles of the fourth surfaces 15-4 and 16-4 and the sixth surfaces 15-6 and 16-6 in the case of the trapezoidal wedge shape, and means the rising angles of the fourth surfaces 17-4 and 18-4 and the fifth surfaces 17-5 and 18-5 in the case of the triangular wedge shape.

Figure 10:
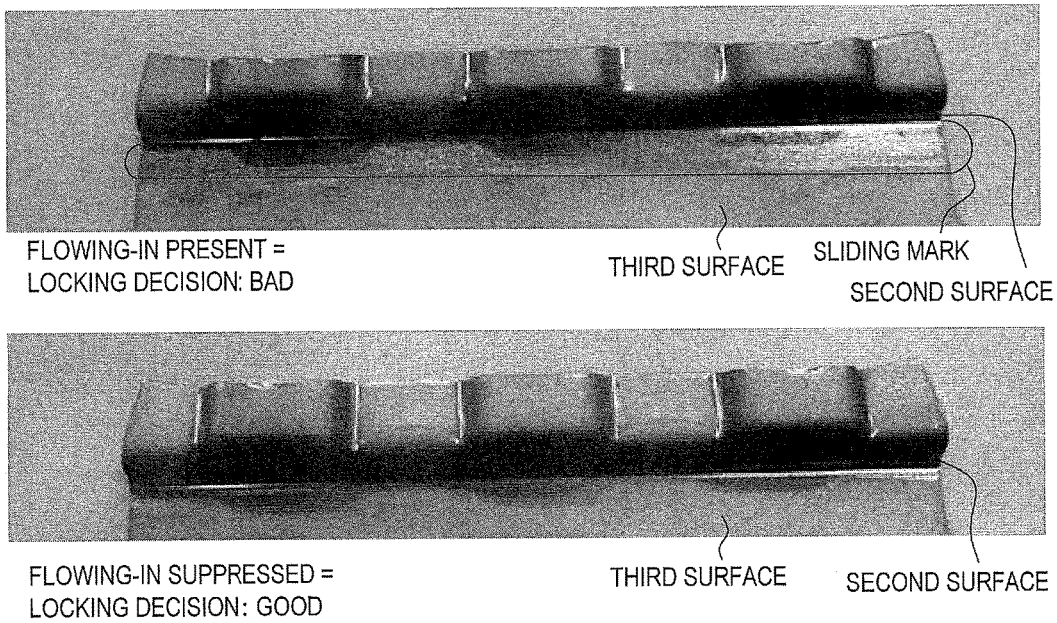
FIG. 10 is photographs for explaining a difference in blank flowing mark due to a difference in decision on lock performance.

FIG. 10 shows the sliding marks on the blank individually in a case where decision on the locking performance is good and in a case where it is bad. A photograph shown at the top of FIG. 10 is a photograph obtained by photographing the blank in the case where decision on the locking performance is bad from the blank holder side, and a photograph shown at the bottom of FIG. 10 is a photograph obtained by photographing the blank in the case where decision on the locking performance is good from the blank holder side. In the case where decision on locking is bad, the sliding mark on the blank is observed from a corner of the boundary between the second surface and the third surface to the third surface side. In contrast thereto, in the case where decision on locking is good, few sliding marks are observed on the blank.

As indicated on the Table 1, in case of the wedge-shaped bead having a trapezoidal wedge shape, the Comparative example 3 in which the pitch interval is 80 mm, the Comparative example 4 in which the wedge height is 0.5 mm, the Comparative example 5 in which the wedge wall angle is 15 degrees and the Comparative example 7 in which there is no step have lowered locking performance and it was not possible to ensure the locking force required for the stretch forming. Among them, in regard to the Comparative example 7, the influence on the product surface was also observed. In regard to the Comparative example 5, it is conceivable that it is affected by increase in the wedge pitch in combination with a small wedge wall angle. In addition, in the Comparative example 6 in which the wedge height is 20.0 mm, the blank of the clamp target part was destroyed, the locking force could not be evaluated and also the material yield was lowered.

On the other hand, it was found that in the case of the wedge-shaped bead having the trapezoidal wedge shape, if the pitch interval is within a range of 5 to 50 mm and the wedge height is within a range of 1.0 to 10.0 mm, the locking force required for the stretch forming can be ensured and also the material yield of the blank can be improved.

Meanwhile, in the case of the wedge-shaped bead having the triangular wedge shape, the Comparative examples 8, 9, 11, and 12 in which the wedge wall angle is 4 degrees or 6 degrees have lowered locking performance and it was not possible to ensure the locking force required for the stretch forming. In addition, in the Comparative example 10 in which the wedge height is 10.0 mm, the wedge wall angle reached 45 degrees, the blank of the clamp target part was destroyed, the wrinkles were generated on the blank, the locking force could not be evaluated and also the material yield was lowered.

On the other hand, in the case of the wedge-shaped bead having the triangular wedge shape, it was found that, if the pitch interval is within a range of 5 to 50 mm and the wedge wall angle is within a range of 10 to 40 degrees, the locking force required for the stretch forming can be ensured and also the material yield of the blank can be improved.

(Evaluation 3)

Figure 11:
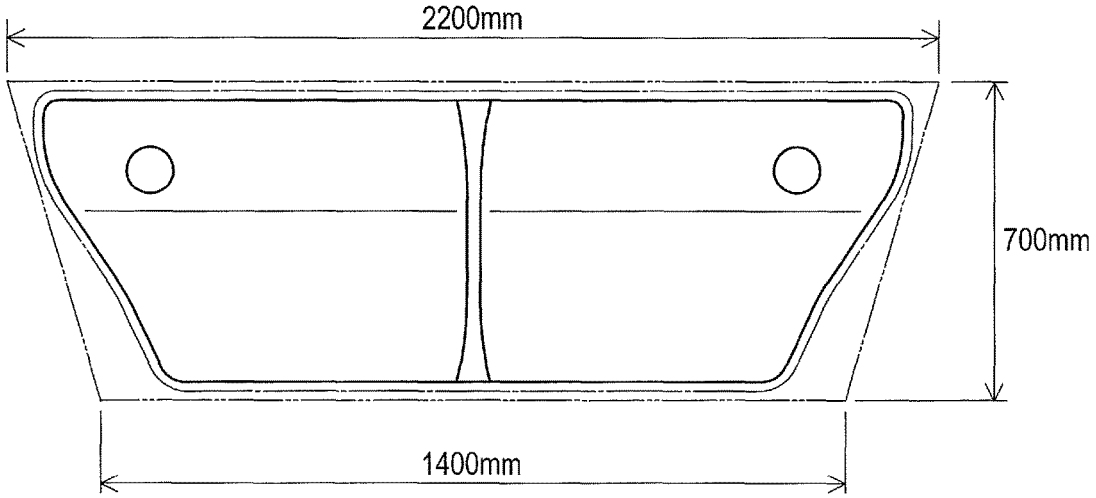
FIG. 11 is a front view showing an outline shape of a blank of a stretch-formed product manufactured through an Evaluation 3 in the Example.
Figure 12:
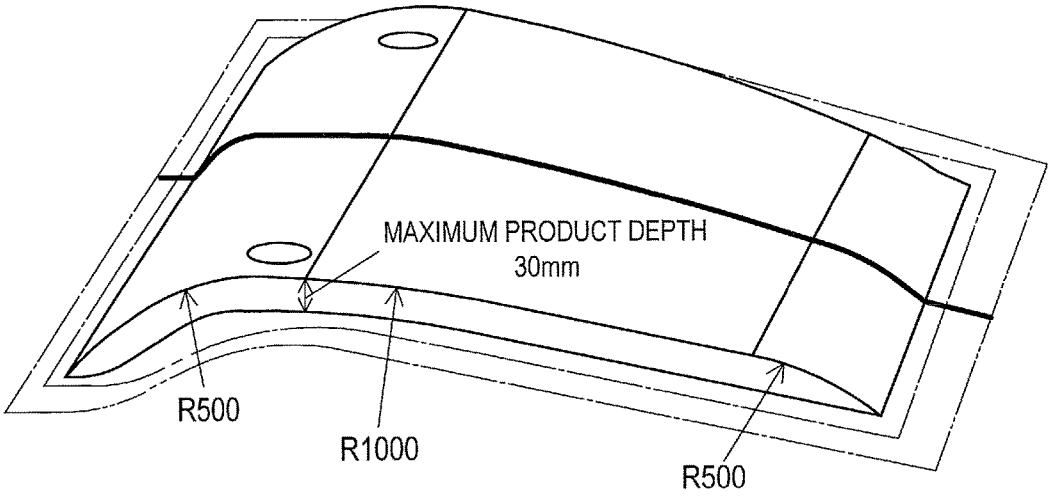
FIG. 12 is a perspective view showing a dimension of each part of the stretch-formed product manufactured through the Evaluation 3 in the Example.
Figure 13:
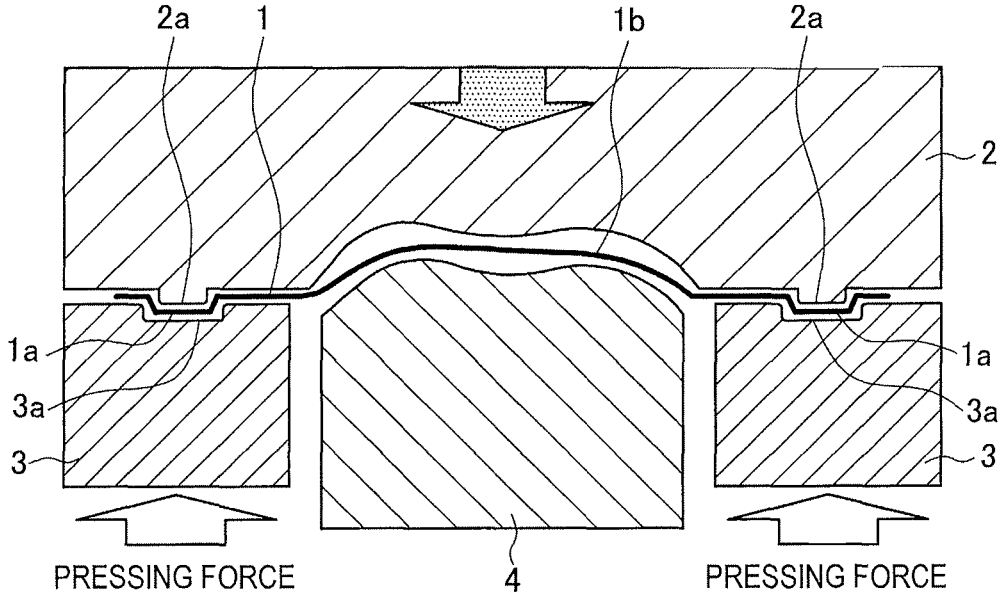
FIG.13 CONVENTIONAL ART
FIG. 13 is an explanatory diagram showing a state of stretch forming.
Figure 14:
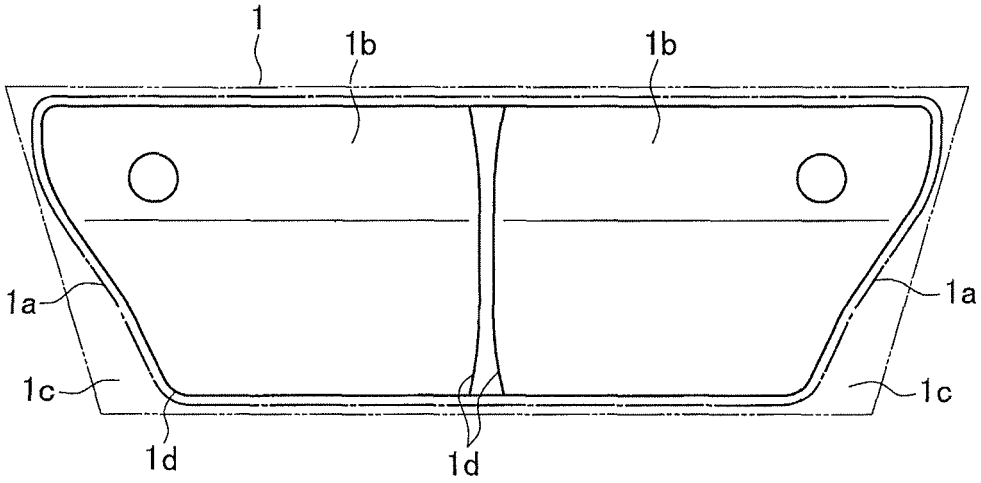
FIG.14 CONVENTIONAL ART
FIG. 14 is an explanatory diagram showing one example of the blank used in the stretch forming.

In the Evaluation 3, in regard to the case where the wedge-shaped bead was used and the case where the conventional trapezoidal bead was used, the material yield of the blank was individually evaluated. FIG. 11 and FIG. 12 are diagrams showing the blank and an outline shape of the stretch-formed product manufactured in the Example and the Comparative example. FIG. 11 is a front view of the blank of the stretch-formed product and FIG. 12 is a perspective view showing the dimension of each part of the stretch-formed product. The stretch-formed product is a formed product which has been formed modeling after the door outer panel.

In the Example, the stretch forming was performed by using the die and the blank holder having the wedge-shaped beads 15 and 16 shown in FIG. 2 to FIG. 4 and the stretch-formed product shown in FIG. 11 and FIG. 12 was manufactured. In addition, as the Comparative example, the stretch forming was performed by using the die and the blank holder having the conventional trapezoidal beads shown in FIG. 15 to FIG. 17 and the stretch-formed product shown in FIG. 11 and FIG. 12 was manufactured. In the both, the blank used was the alloyed hot dip galvanized steel sheet which is 0.7 mm in sheet thickness and is at the 340 MPa level in tensile strength measured in the tensile test based on JIS Z 2241. In both cases, the blank of a minimum area which would not hinder the stretch forming was used.

The pressing length L1 of the clamp target part of the blank to be clamped by each lock bead was 9.5 mm in the Example and 19.0 mm in the Comparative example. Consequently, while the area of the blank in the Example was about 1.372 $m^2$, the area of the blank in the Comparative example was 1.425 $m^2$. Accordingly, in the case where the wedge-shaped beads of the Example were used, the yield of material in the stretch forming was improved by about 4% in comparison with the case where the trapezoidal beads of the Comparative example were used. At present, improvement of the yield of material in the stretch forming is in a situation that it almost reaches its limit and it is an extremely noticeable effect that the yield of the material can be improved by about 4%.

REFERENCE SIGNS LIST

10 manufacturing apparatus
1 die
11*a* clamping surface
12 blank holder
12*a* clamping surface
13 punch
14 blank
14*a* clamp target part
14*b* forming region
14*c* outer peripheral part
14*d* trim line
15, 16, 17, 18 wedge-shaped bead (lock bead)
15-1, 16-1, 17-1, 18-1 first surface
15-2, 16-2, 17-2, 18-2 second surface
15-3, 16-3, 17-3, 18-3 third surface
15-4, 16-4, 17-4, 18-4 fourth surface
15-5, 16-5, 17-5, 18-5 fifth surface
15-6, 16-6 sixth surface
54 blank
55 clamp target part
58 chuck
61 die
62 blank holder

The invention claimed is:

1. A manufacturing apparatus for a stretch-formed product, the manufacturing apparatus comprising:

a die and a blank holder which have clamping surfaces facing each other;

a punch that, in a state where a margin of a blank of a sheet material is clamped by the clamping surfaces of the die and the blank holder, relatively presses a forming region of the blank into the die and thereby performs stretch forming on the forming region of the blank; and lock beads that are provided on the clamping surfaces of the die and the blank holder in mutually similar shapes and have first surfaces, second surfaces that intersect with the first surfaces, and third surfaces that intersect with the second surfaces from outer edges toward centers of the die and the blank holder, the first surfaces each having a plurality of depression-protrusion parts, wherein the plurality of depression-protrusion parts each have a fourth surface and a sixth surface facing each other and a fifth surface that intersects with the fourth surface and the sixth surface, the fourth surface, the fifth surface and the sixth surface intersect with the second surface, and when the plurality of depression-protrusion parts are viewed from the outer edge toward the center of the blank holder, the plurality of depression-protrusion parts have a trapezoidal shape, a rectangular shape or a combined shape thereof.

2. The manufacturing apparatus for a stretch-formed product according to claim 1, wherein in a case where the plurality of depression-protrusion parts each have the trapezoidal shape or the rectangular shape, a pitch interval of the plurality of depression-protrusion parts when a set of a protruded shape and a depressed shape is defined as one pitch is within a range of 5 to 50 mm and a height of the depression-protrusion part is within a range of 1.0 to 10.0 mm.

3. A manufacturing method for a stretch-formed product, the manufacturing method comprising the steps of:

placing a blank of a sheet material between a die and a blank holder which include, on clamping surfaces facing each other, lock beads that have first surfaces, second surfaces that intersect with the first surfaces and third surfaces that intersect with the second surfaces from outer edges toward centers, the first surfaces each having a plurality of depression-protrusion parts, and the lock beads being provided in mutually similar shapes;

clamping a margin of the blank by the die and the blank holder; and stretch-forming the blank by relatively pressing a forming region of the blank into the die by a punch in a state of clamping the margin of the blank, wherein the plurality of depression-protrusion parts each have a fourth surface and a sixth surface facing each other and a fifth surface that intersects with the fourth surface and the sixth surface, the fourth surface, the fifth surface and the sixth surface intersect with the second surface, and when the plurality of depression-protrusion parts are viewed from the outer edge toward the center of the blank holder, the plurality of depression-protrusion parts have a trapezoidal shape, a rectangular shape or a combined shape thereof.

* * * * *